US008848491B2

(12) United States Patent
Miyake

(10) Patent No.: US 8,848,491 B2
(45) Date of Patent: Sep. 30, 2014

(54) ANALOG ELECTRONIC TIMEPIECE

(75) Inventor: Takeshi Miyake, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 268 days.

(21) Appl. No.: 13/562,585

(22) Filed: Jul. 31, 2012

(65) Prior Publication Data

US 2013/0033970 A1 Feb. 7, 2013

(30) Foreign Application Priority Data

Aug. 1, 2011 (JP) ..... 2011-167946

(51) Int. Cl.

| | |
|---|---|
| ***G04B 19/04*** | (2006.01) |
| ***G04G 9/00*** | (2006.01) |
| ***G04C 3/14*** | (2006.01) |
| ***G04C 17/00*** | (2006.01) |

(52) U.S. Cl.

CPC ..... *G04C 17/00* (2013.01); *G04G 9/0064* (2013.01); *G04C 3/146* (2013.01)

USPC ..... 368/80; 368/228

(58) Field of Classification Search

USPC ..... 368/4, 80, 223, 228, 232, 238

See application file for complete search history.

(56) References Cited

U.S. PATENT DOCUMENTS

| | | | | |
|---|---|---|---|---|
| 5,500,835 | A | 3/1996 | Born | |
| 5,508,978 | A * | 4/1996 | Kalbermatter et al. | 368/13 |
| 5,508,980 | A * | 4/1996 | Koch | 368/80 |
| 5,572,488 | A | 11/1996 | Yamada et al. | |
| 6,272,076 | B1 | 8/2001 | Dinger | |
| 6,356,512 | B1 * | 3/2002 | Martin et al. | 368/10 |
| 6,463,011 | B1 * | 10/2002 | Christen et al. | 368/69 |
| 6,490,230 | B1 * | 12/2002 | Sakuyama et al. | 368/11 |
| 7,187,908 | B2 | 3/2007 | Fujisawa et al. | |
| 7,215,601 | B2 * | 5/2007 | Plancon et al. | 368/10 |
| 7,596,057 | B2 * | 9/2009 | Linder et al. | 368/80 |
| 7,623,415 | B2 | 11/2009 | Raeber et al. | |

FOREIGN PATENT DOCUMENTS

| | | | |
|---|---|---|---|
| CN | 100442174 | C | 12/2008 |
| EP | 0 493 613 | A1 | 7/1992 |
| EP | 0 670 532 | A1 | 9/1995 |
| EP | 1 930 795 | A1 | 6/2008 |

(Continued)

OTHER PUBLICATIONS

Extended European Search Report (Eesr) dated Oct. 8, 2012 (in English) issued in counterpart European Application No. 12178682.6.

(Continued)

*Primary Examiner* — Sean Kayes

(74) *Attorney, Agent, or Firm* — Holtz Holtz Goodman & Chick PC

(57) ABSTRACT

An analog electronic timepiece includes a plurality of hands; a dial plate having scales for time display; a driving unit that drives the hands so that the hands are driven independently of each other; and a control unit that transmits a drive signal to the driving unit and moves the hands to allow the hands to point to positions set for the respective hands. The control unit (i) allows each hand to point to one of positions of one o'clock to nine o'clock and twelve o'clock among the scales to indicate that a digit in a predetermined place represented by each hand is one of "1" to "9" and "0"; and (ii) expresses a numerical value by a combination of digits corresponding to the respective positions pointed by the respective hands.

20 Claims, 9 Drawing Sheets

(56) References Cited

FOREIGN PATENT DOCUMENTS

| | | | |
|---|---|---|---|
| JP | 57-066377 | A | 4/1982 |
| JP | 60-162980 | A | 8/1985 |
| JP | 07-043479 | A | 2/1995 |
| JP | 2000-065958 | A | 3/2000 |
| JP | 2002-257955 | A | 9/2002 |
| JP | 2004-226350 | A | 8/2004 |
| JP | 2008-261683 | A | 10/2008 |
| WO | WO 95/16939 | A1 | 6/1995 |

OTHER PUBLICATIONS

Chinese Office Action dated Feb. 8, 2014 (and English translation thereof) in counterpart Chinese Application No. 201210271271.1.
Japanese Office Action dated Apr. 2, 2013 (and English translation thereof) in counterpart Japanese Application No. 2011-167946.

* cited by examiner

ANALOG ELECTRONIC TIMEPIECE

BACKGROUND OF THE INVENTION

1. Field of the Invention

The present invention relates to an analog electronic timepiece that displays time and numerical values other than time.

2. Description of Related Art

A conventional electronic timepiece has a measuring unit, such as a temperature sensor or a barometric pressure sensor, and provides an analog representation of a measured value of a physical quantity using a hand. Separately from scales for time display, such an electronic timepiece has scales for displaying a measured value on a dial plate or on a bezel of a wrist timepiece, and drives one or more hands independently to point to the scales to indicate the measured value.

Some electronic timepiece having such a measurement function uses any of an hour hand, a minute hand, and a second hand, or a function hand to indicate which type of function the display of the electronic timepiece relates to Japanese Unexamined Patent Application Publication No. 2004-226350 discloses a technology in which a second hand is extended in the direction opposite to a portion of the hand pointing to seconds, relative to a rotation axis. Further, scales to be indicated by the extended portion of the second hand are provided, which makes it possible to display operation information or status. According to this technology, information indicated by the scales can easily be read without increasing the number of hands.

In displaying a numerical value with an analog electronic timepiece, however, a range of numerical values and the number of significant digits for time display are often considerably different from those for other purposes. If various types of scales are provided on a dial plate or a bezel for various purposes, display is crowded. In addition, the range of numerical values is considerably different depending on a displayed item other than the time, such as, for example, temperature for which a value after the decimal point is displayed, and barometric pressure for which a value of 1,000 or greater is displayed. Using the same scales to display these different types of numerical values reduces readability of numerical values since scales are too rough or too fine depending on a displayed item. However, if different types of scales are provided for different types of numerical values to be displayed, a dial plate or a bezel is filled with scales.

SUMMARY OF THE INVENTION

The present invention provides an analog electronic timepiece whose scales are efficiently used, and which allows a user to easily read numerical values.

According to an aspect of the present invention, there is provided an analog electronic timepiece including: a plurality of hands; a dial plate having scales for time display; a driving unit that drives the hands in such a way that the hands are driven independently of each other; and a control unit that transmits a drive signal to the driving unit and moves the hands to allow the hands to point to positions set for the respective hands, wherein the control unit (i) allows each of the hands to point to one of positions of one o'clock to nine o'clock and twelve o'clock among the scales for time display to indicate that a digit in a predetermined place represented by each of the hands is one of "1" to "9" and "0"; and (ii) expresses a numerical value by a combination of digits corresponding to the respective positions pointed by the respective hands.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

First Embodiment

Embodiments of the present invention are described below with reference to the attached drawings.

Figure 1:
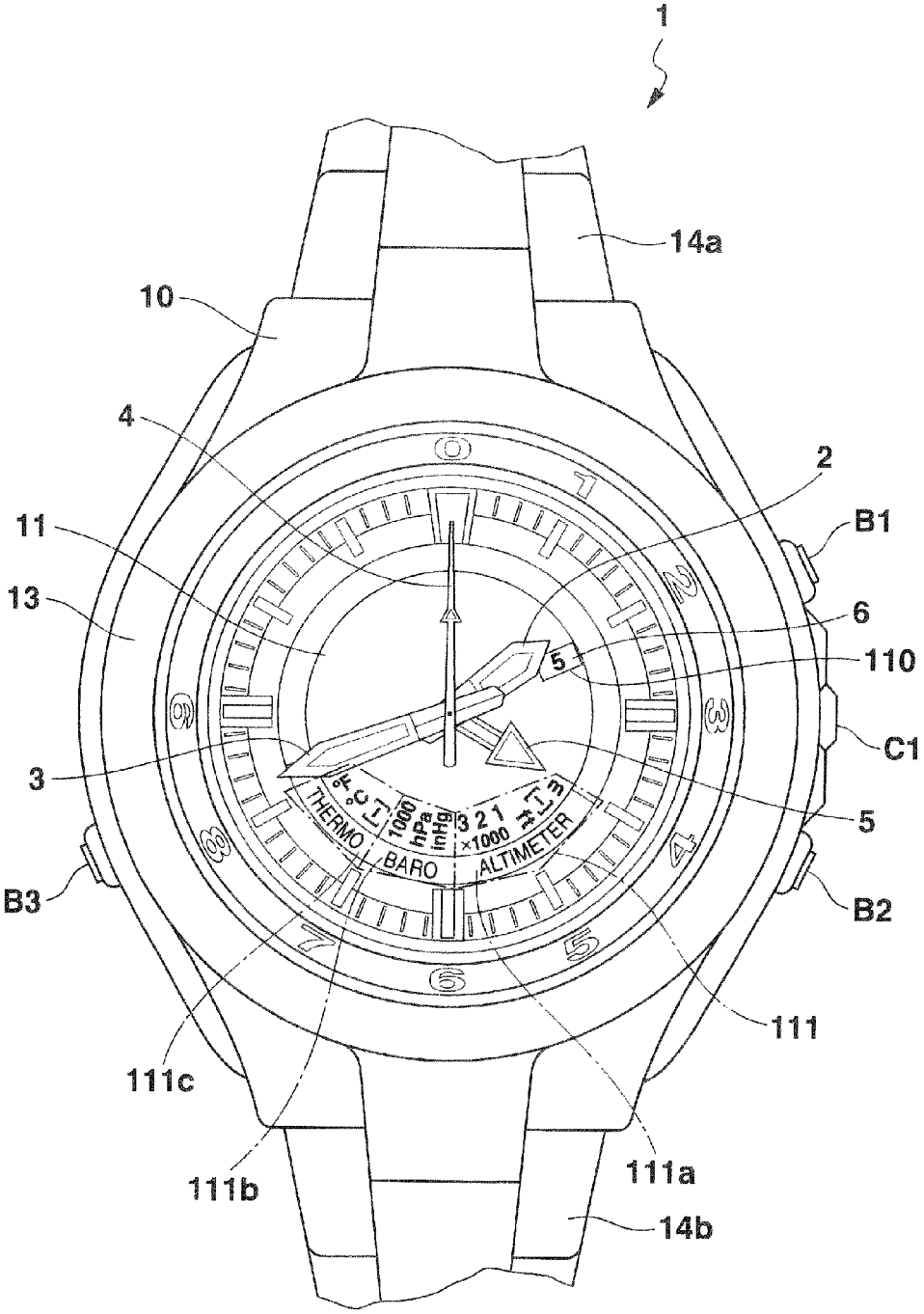
FIG. 1 is an entire view illustrating an analog electronic timepiece according to an embodiment of the present invention.

FIG. 1 is an entire view illustrating an analog electronic timepiece according to a first embodiment of the present invention.

The analog electronic timepiece according to the embodiment is an electronic wrist timepiece 1 wearable on the arm of a user by bands 14*a* and 14*b*. The electronic wrist timepiece 1 has a casing 10; a dial plate 11; and an hour hand 2, a minute hand 3, a second hand 4 (hereinafter these hands collectively referred to as hands 2 to 4), and a function hand 5, which are provided between the dial plate 11 and a windshield (not shown in the drawing) covering the dial plate 11, so as to be rotatable around a rotation axis at the center of the dial plate 11. A date indicator 6 that indicates a date is provided below the dial plate 11 so as to be in parallel with the dial plate 11. An annular bezel 13 is provided on the periphery of the windshield. Three buttons B1 to B3 and a winder C1 are provided on a lateral portion of the casing 10.

Sixty scales to indicate time are provided at regular intervals on the same circumference of the dial plate 11. Inside the time scales, function scales 111 to which the function hand 5 points are provided in the directions between four o'clock and eight o'clock. A small window 110 is provided at the position of two o'clock. A date written on the upper surface of the date indicator 6 is exposed through the small window 110. Outside the time scales, numbers "0" to "9" are written in the directions of twelve o'clock to nine o'clock, respectively, in the peripheral portion of the dial plate 11.

Figure 2:
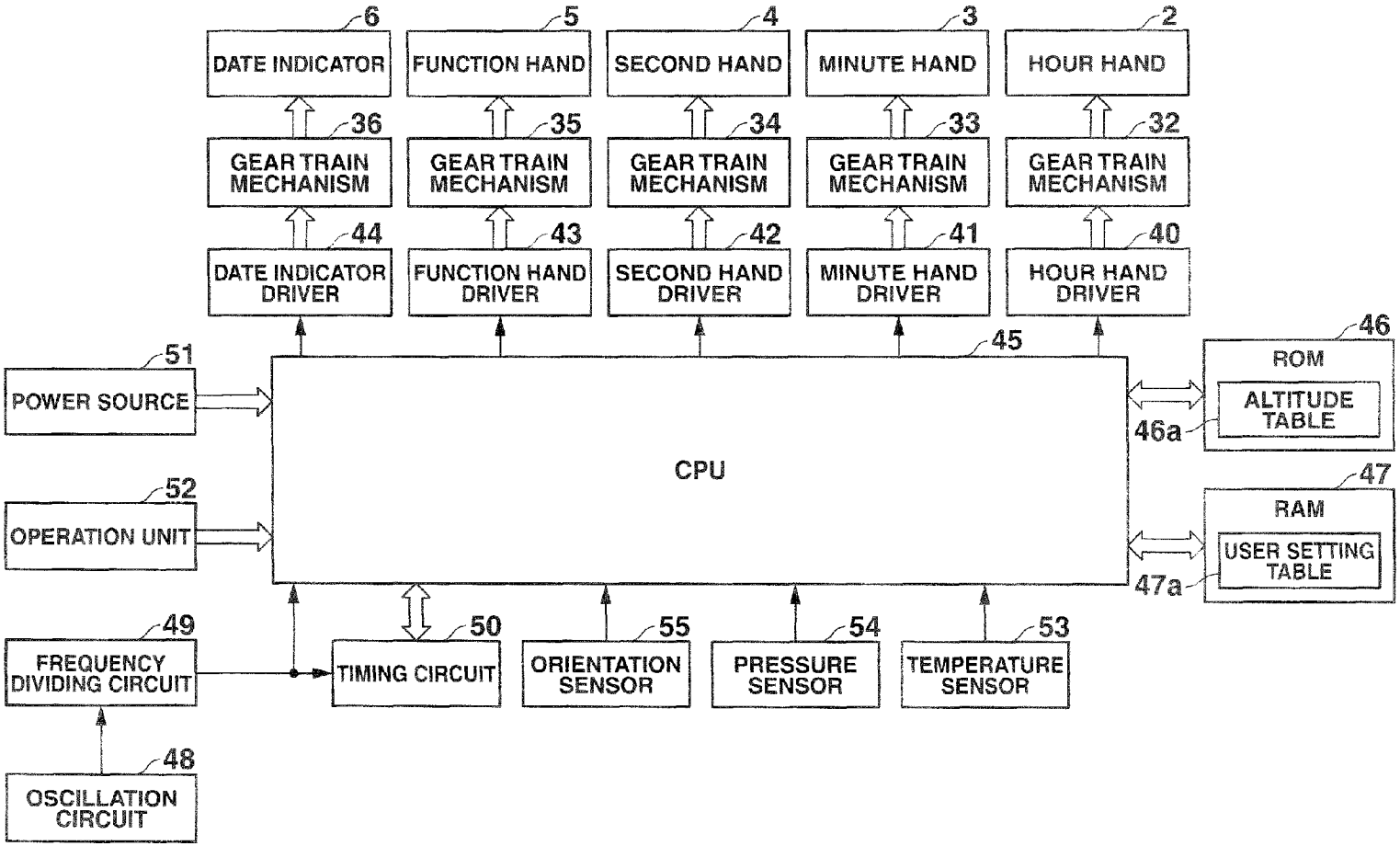
FIG. 2 is a block diagram illustrating an internal configuration of the analog electronic timepiece.

FIG. 2 is a block diagram illustrating the internal configuration of the electronic wrist timepiece 1.

The electronic wrist timepiece 1 has the hour hand 2, the minute hand 3, the second hand 4, the function hand 5, the date indicator 6, an hour hand driver 40 driving the hour hand 2 through a gear train mechanism 32, a minute hand driver 41 driving the minute hand 3 through a gear train mechanism 33, a second hand driver 42 driving the secondhand 4 through a gear train mechanism 34, a function hand driver 43 driving the function hand 5 through a gear train mechanism 35, a date indicator driver 44 driving the date indicator 6 through a gear train mechanism 36, an oscillation circuit 48, a frequency dividing circuit 49, a timing circuit 50, a CPU (central processing unit) 45, a ROM (read only memory) 46, a RAM (random access memory) 47, a power source 51, an operation unit 52, a temperature sensor 53, a pressure sensor 54, and an orientation sensor 55.

In the electronic wrist timepiece 1, the hands 2 to 4, the function hand 5, and the date indicator 6 are independently driven by separate drivers (driving unit) based on drive control signals output from the CPU 45 that serves as a control unit. The hour hand driver 40, the minute hand driver 41, the second hand driver 42, the function hand driver 43, and the date indicator driver 44 (hereinafter these hand drivers collectively referred to as drivers 40 to 44) can advance or reverse the hands 2 to 4, the function hand 5, and the date indicator 6, respectively. The maximum advance speeds of the hands 2 to 4, the function hand 5, and the date indicator 6 by the drivers 40 to 44, respectively, are set to be double the maximum reverse speeds thereof.

The second hand 4 can move to positions of every six degrees, i.e., positions of 60 steps included in one full circle. The second hand driver 42 advances the secondhand 4 by one step every one second in a time display mode. The hour hand 2 and the minute hand 3 can indicate positions of every one degree, i.e., positions of 360 steps included in one full circle. The minute hand driver 41 advances the minute hand 3 by one step every 10 seconds in the time display mode. The hour hand driver 40 advances the hour hand 2 by one step every two minutes in the time display mode. The date indicator 6, which has a disk, annular, or arcuate shape, has numbers 1 to 31 at predetermined angle intervals on the same circumference on the upper surface thereof. The date indicator driver 44 drives the date indicator 6 such that, for example, the date exposed through the small window 110 changes at the time when the date changes.

The function hand 5 points to any of the function scales 111 that include types of unit system and supplementary information, such as information of a negative value or a digit in the fourth place. A character/mark representing a day (not shown in the drawing) is provided between the small window 110 and the function scales 111 on the dial plate 11. The function hand 5 pointing to the character/mark indicates that the timepiece 1 is in the time display mode. Alternatively, another character/mark may be provided, separately from the character/mark for a day, in the function scales 111 to indicate the time display mode. The function hand 5 of the electronic wrist timepiece 1 of the embodiment is rotatable only between the date in the direction of two o'clock and the mark "° F." in the direction of eight o'clock in the function scales 111.

The oscillation circuit 48 generates a frequency signal having a predetermined frequency, such as 1.6384 MHz, and outputs the frequency signal to the frequency dividing circuit 49. The frequency dividing circuit 49 divides the frequency of the signal received from the oscillation circuit 48 at a set frequency dividing ratio and outputs one-second signals to the timing circuit 50. The frequency dividing circuit 49 also outputs, to the CPU 45, signals having a set frequency to be used by the CPU 45.

The timing circuit 50 counts the one-second signals to count time. The timing circuit 50 counts the time independently of time display by the hands 2 to 4. The time data counted by the timing circuit 50 is correctable based on a correction command from the CPU 45.

The CPU 45 comprehensively controls the entire operations of the electronic wrist timepiece 1 and performs a variety of calculations. In the time display mode, the CPU 45 outputs drive control signals to the drivers 40 to 44 based on a time data signal received from the timing circuit 50. In measuring a variety of physical quantities, the CPU 45 determines target positions to which the hands 2 to 4 and the function hand 5 are to be moved, based on measured values received from the sensors 53 to 55 (described below) and outputs drive control signals to the drivers 40 to 43 to move the hands 2 to 4 and the function hand 5 to the target positions.

The ROM 46 stores a variety of control programs, function programs, and set data to be executed by the CPU 45. The function programs include an altitude display program, a barometric pressure display program, and a temperature display program. The altitude display program measures barometric pressure, converts the measured value into an altitude value, and displays the altitude value with the hands 2 to 4 and the function hand 5. The barometric pressure display program displays the measured barometric pressure with the hands 2 to 4 and the function hand 5. The temperature display program measures and displays temperature with the hands 2 to 4 and the function hand 5. The CPU 45 reads out these programs and set data as required and loads them in the RAM 47 for execution. The ROM 46 stores an altitude table **46*a*** which is a default conversion table of barometric pressure and altitude.

The RAM 47 provides a work memory space for the CPU 45. The CPU 45 temporarily stores therein values acquired by executing the control programs or the function programs, or set or calculated values. The RAM 47 also stores a user setting table **47*a* that includes data based on user settings. The data includes correction data for the altitude table 46*a*** and unit settings (for example, Celsius, Fahrenheit, hPa, in Hg, meters, and feet) for displaying temperature, barometric pressure, and altitude.

The power source 51 supplies power required to drive the CPU 45. The power source 51 may be, for example, a combination of a solar battery and a rechargeable battery, but is not particularly limited thereto.

The temperature sensor 53 and the pressure sensor 54 that serve as a measuring unit measure temperature and barometric pressure, respectively. The temperature sensor 53 is composed of a temperature sensor IC, for instance, that converts a temperature value calculated from a resistance value of a semiconductor into digital data and outputs the data. The pressure sensor 54 is, for example, a semiconductor sensor that measures barometric pressure using a piezoelectric element. The orientation sensor 55 measures orientation, for example, based on geomagnetic field using a magnetoresistive element.

The operation section 52 transmits, to the CPU 45, electrical signals associated with operations of the buttons B1 to B3 and the winder C1 as input signals. For instance, when the button B1 is pressed, the CPU 45 changes the mode to an orientation display mode and displays orientation with the hands 2 to 4, based on orientation data obtained by the orientation sensor 55. A conventional technology can be applied to a method of displaying the orientation. For instance, the second hand 4 is driven at a predetermined time interval so as to point to magnetic north. When the button B2 is pressed, the CPU 45 changes the mode to an altitude display mode, calculates an altitude value based on barometric pressure data obtained by the pressure sensor 54, and displays the altitude value with the hands 2 to 4 and the function hand 5. The altitude display operation will be described later. When the button B3 is pressed, the CPU 45 changes the mode from the time display mode to each mode in sequence. When the winder C1 is operated, the CPU 45 allows a user to manually change the time data of the timing circuit 50 or to manually set correction data for the altitude table in the user setting table 47*a*.

Figure 3A:
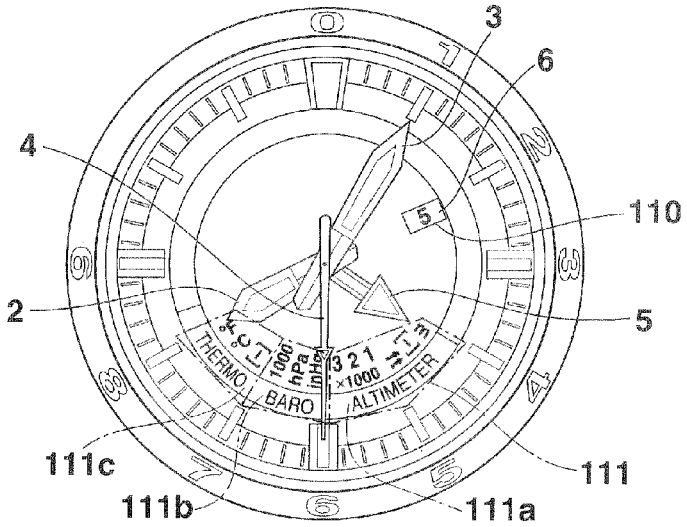
FIGS. 3A to 3C are each a plan view illustrating an exemplary display of a measured value.
Figure 3B:
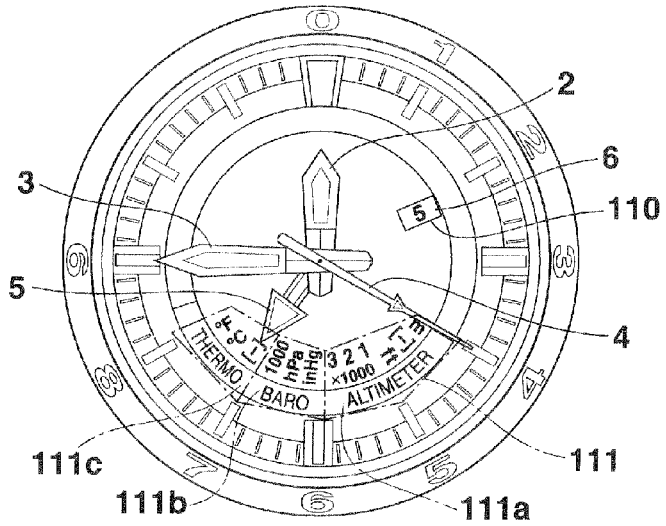
Figure 3C:
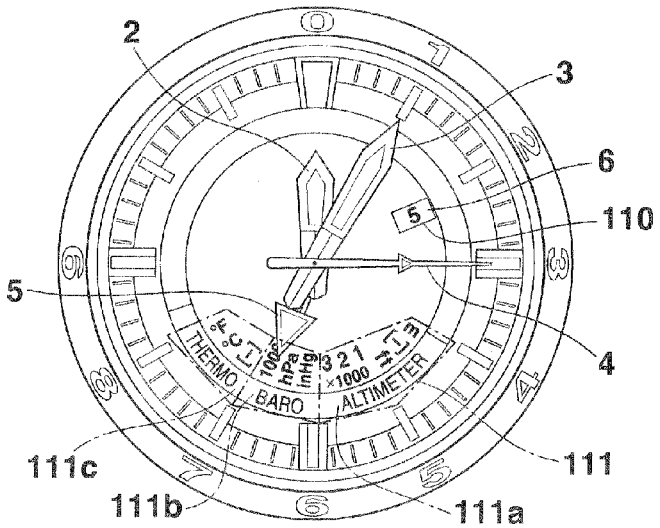

The operation of displaying a measured value in the electronic wrist timepiece 1 of the embodiment will now be described. FIGS. 3A to 3C are each a plan view illustrating an exemplary display of a measured value in the electronic wrist timepiece 1.

As shown in FIG. 3A, in the case of altitude display, the function hand 5 points to any of the marks in an altitude indication section 111*a* indicated by "ALTIMETER." In this example, the function hand 5 points to the mark "m," which indicates that a value is expressed in meters.

The hour hand 2 points to the direction of eight o'clock indicated by "8" on the dial plate 11; the minute hand 3 points to the direction of one o'clock indicated by "1" on the dial plate 11; and the second hand 4 points to the direction of six o'clock indicated by "6" on the dial plate 11. In the altitude display in the electronic wrist timepiece 1 of the embodiment, the hour hand 2 represents a digit in the thousands place in meters; the minute hand 3 represents a digit in the hundreds place in meters; and the second hand 4 represents a digit in the tens place in meters. Thus, the hands 2 to 4 and the function hand 5 indicate an altitude of 8×1,000+1×100+6×10 "m," i.e., 8,160 m. Thereby, in the electronic wrist timepiece 1 of the embodiment, the directions of the numbers "0" to "9" on the dial plate 11 are associated with the respective digits of the displayed numerical value. Each of the hands 2 to 4 points to a number corresponding to a digit of a predetermined place in a numerical value. A numerical value is expressed by a combination of these digits.

As shown in FIG. 3B, in the case of temperature display, the function hand 5 points to any of the marks in a temperature indication section 111*c* indicated by "THERMO." In this example, the function hand 5 points to the mark "−" that indicates subfreezing temperature. Whether a display unit is Celsius or Fahrenheit is indicated in such a way that, during temperature measurement, the function hand 5 points to the mark "° C." that represents Celsius or the mark "° F." that represents Fahrenheit, and then, moves to the mark "−" (described later).

The hour hand 2 points to the number "0;" the minute hand 3 points to the number "9;" and the second hand 4 points to the number "4." In the temperature display in the electronic wrist timepiece 1 of the embodiment, the hour hand 2 represents a digit in the tens place in degrees; the minute hand 3 represents a digit in the ones place in degrees; and the second hand 4 represents a digit in the tenth place in degrees. Thus, the hands 2 to 4 and the function hand 5 indicate a temperature of −1×(0×10+9×1+4×0.1) "° C.," i.e., −9.4° C.

As shown in FIG. 3C, in the case of barometric pressure display, the function hand 5 points to any of the marks in a barometric pressure indication section 111*b* indicated by "BARO." In this example, the function hand 5 points to the mark "1000," which indicates that a barometric pressure is 1,000 hPa or greater.

The hour hand 2 points to the number "0;" the minute hand 3 points to the number "1;" and the second hand 4 points to the number "3." In the barometric pressure display in the electronic wrist timepiece 1 of the embodiment, the hour hand 2 represents a digit in the hundreds place; the minute hand 3 represents a digit in the tens place; and the second hand 4 represents a digit in the ones place. Thus, the hands 2 to 4 and the function hand 5 indicate a barometric pressure of 1,000+0×100+1×10+3×1 "hPa," i.e., 1,013 hPa.

In a below sea level or underground area, the function hand 5 of the electronic wrist timepiece 1 points to the mark "−" in the altitude indication section 111*a* to indicate negative altitude. When altitude is displayed in feet, a digit in the tens of thousands place is required for a high mountain or up in the air. The function hand 5 then points to any of the marks "1," "2," and "3" to indicate 10,000-feet range, 20,000-feet range, and 30,000-feet range, respectively.

Figure 4:
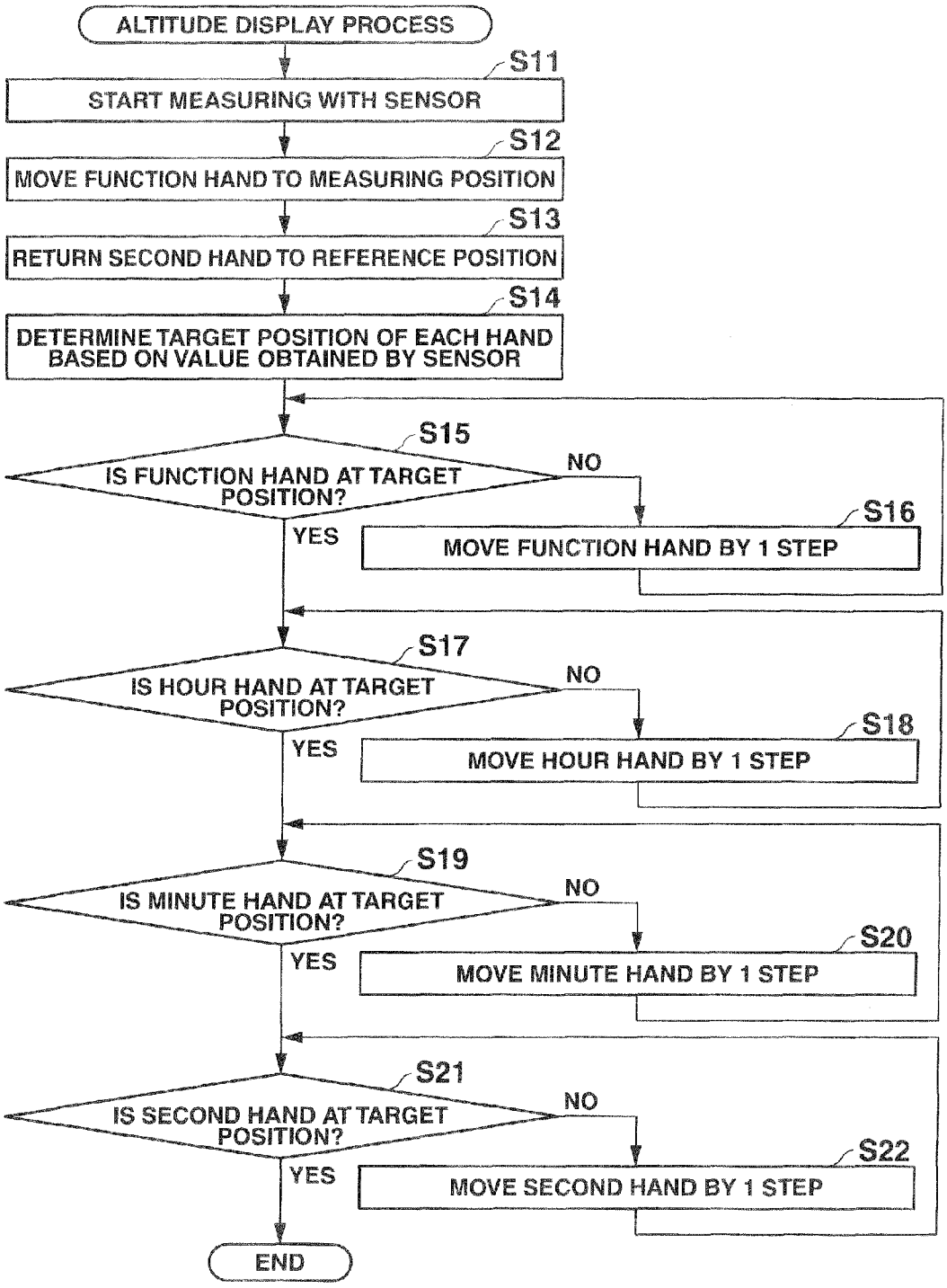
FIG. 4 is a flowchart illustrating a control process for displaying a measured value according to a first embodiment.

FIG. 4 is a flowchart illustrating a control procedure for an altitude display process to be performed by the CPU 45 during the altitude display operation in the electronic wrist timepiece 1 of the first embodiment.

As described above, the altitude display process starts when a user presses the button B2, or presses the button B3 and selects altitude display. Once the altitude display process starts, the CPU 45 transmits a command to the pressure sensor 54 to activate the pressure sensor 54, and measures barometric pressure to output the barometric pressure data to the CPU 45 (Step S11).

The CPU 45 then transmits a drive control signal to the function hand driver 43 to move the function hand 5 to a predetermined position (measuring position) that indicates that altitude is being measured (Step S12). At this time, the CPU 45 reads out a setting associated with the altitude display from the user setting table 47*a* and determines whether the display is in meters or feet based on the setting. For displaying altitude in meters, the CPU 45 outputs a drive control signal to the function hand driver 43 so that the function hand 5 is moved to a position to point to the mark "m" in the altitude display section 111*a*. For displaying altitude in feet, the CPU 45 outputs a drive control signal to the function hand driver 43 so that the function hand 5 is moved to a position to point to the mark "ft" in the altitude display section 111*a*.

The CPU 45 then transmits a drive control signal to the second hand driver 42 to move the second hand 4 to a reference position, which is the position of zero second (direction of twelve o'clock) (Step S13). With the processes of Steps S12 and S13, the CPU 45 indicates that the electronic wrist timepiece 1 is currently in the altitude display mode and is measuring the altitude.

The processes of Steps S12 and S13 can be performed in parallel with the pressure measurement operation by the pressure sensor 54 responding to the command from the CPU 45 in Step S11.

When the pressure (barometric pressure) data obtained by the pressure sensor 54 is input to the CPU 45, the process of Step S13 is performed, and then, the CPU 45 determines target positions to which the hands 2 to 4 and the function hand 5 are to be moved, based on the pressure data (Step S14). The CPU 45 reads out the altitude table 46*a* and the user setting table 47*a* and converts the barometric pressure value into an altitude value in the determined unit. Based on the altitude value, the CPU 45 determines the target positions to which the hands 2 to 4 and the function hand 5 are to be moved. At this time, the CPU 45 also determines directions in which the hands 2 to 4 and the function hand 5 are to be moved respectively, based on positional relationships between the current positions of the hands 2 to 4 and the function hand 5 and the positions to which the hands 2 to 4 and the function hand 5 are to be moved. As described above, the fast forwarding speeds of the hands 2 to 4 and the function hand 5 are set to double the reverse speeds thereof. For example, if the second hand 4 at the reference position is to be moved to one of the positions 1 to 8, the CPU 45 advances the second hand 4, while if the second hand 4 is to be moved to the position 9, the CPU 45 reverses the second hand 4. Thus, the rotation direction of the second hand 4 is set so as to reach the target position in a shorter period of time.

Then, the CPU 45 determines whether the function hand 5 is located at the set target position (Step S15). If the CPU 45 determines that the function hand 5 is not located at the target position, the CPU 45 outputs a drive control signal to the function hand driver 43 to move the function hand 5 by one step in the set rotation direction (Step S16). The process of the CPU 45 then returns to Step S15. The CPU 45 repeats the processes of Steps S15 and S16 until the function hand 5 reaches the set target position.

If the CPU 45 determines that the function hand 5 is located at the set target position, the CPU 45 then determines whether the hour hand 2 is located at the set target position (Step S17). If the CPU 45 determines that the hour hand 2 is not located at the set target position, the CPU 45 outputs a drive control signal to the hour hand driver 40 to move the hour hand 2 by one step in the set rotation direction (Step S18). The process of the CPU 45 then returns to Step S17. The CPU 45 repeats the processes of Steps S17 and S18 until the hour hand 2 is determined to be located at the set target position.

If the CPU 45 determines that the hour hand 2 is located at the set target position, the CPU 45 then determines whether the minute hand 3 is located at the set target position (Step S19). If the CPU 45 determines that the minute hand 3 is not located at the set target position, the CPU 45 outputs a drive control signal to the minute hand driver 41 to move the minute hand 3 by one step in the set rotation direction (Step S20). The process of the CPU 45 then returns to Step S19. The CPU 45 repeats the processes of Steps S19 and S20 until the minute hand 3 is determined to be located at the set target position.

If the CPU 45 determines that the minute hand 3 is located at the set target position, the CPU 45 then determines whether the second hand 4 is located at the set target position (Step S21). If the CPU 45 determines that the second hand 4 is not located at the set target position, the CPU 45 outputs a drive control signal to the second hand driver 42 to move the second hand 4 by one step in the set rotation direction (Step S22). The process of the CPU 45 then returns to Step S21. The CPU 45 repeats the processes of Steps S21 and S22 until the second hand 4 is determined to be located at the set target position.

In Step S21, if the CPU 45 determines that the secondhand 4 is located at the set target position, the CPU 45 ends the altitude display process.

In the altitude display process of the first embodiment, the hands 2 to 4 and the function hand 5 are moved to the target positions one by one in sequence.

Figure 5A:
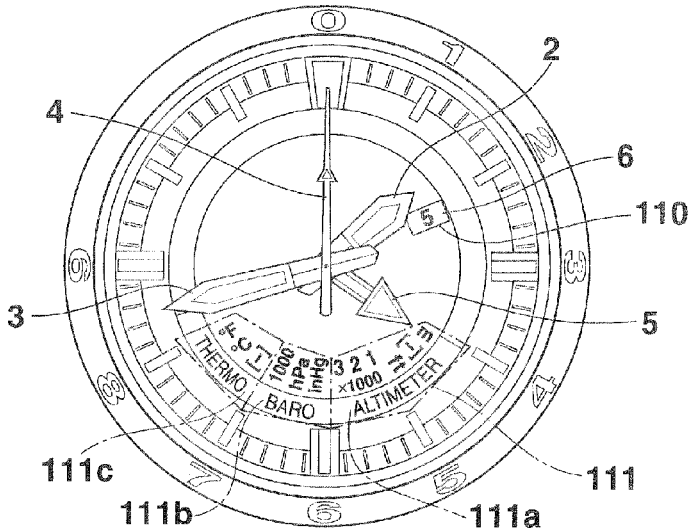
FIGS. 5A to 5C are each a specific example of a procedure for displaying a measured value in an electronic wrist timepiece according to the first embodiment.
Figure 5B:
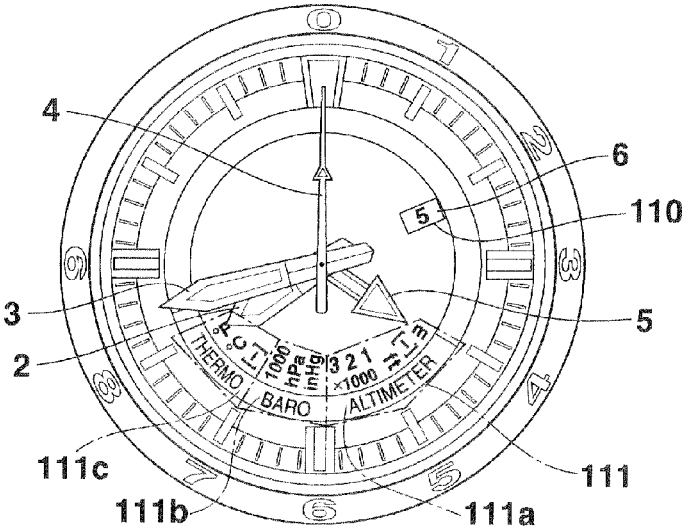
Figure 5C:
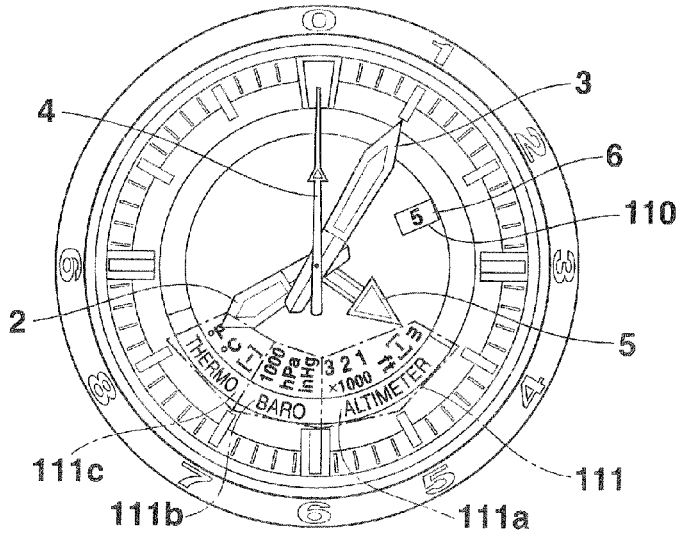

FIGS. 5A to 5C are each a specific example of hand display during the altitude display operation in the electronic wrist timepiece 1 of the first embodiment.

In the case where the current time is one o'clock 42 minutes 32 seconds, for instance, when the altitude display process starts, the CPU 45 drives the function hand 5 to point to the mark "m" in the altitude display section 111*a* (Step S12) and the second hand 4 to point to the number "0" (Step S13), as shown in FIG. 5A, thus indicating that the electronic wrist timepiece 1 is in the altitude display mode and that the pressure sensor 54 is measuring the barometric pressure (Step S11). The CPU 45 makes the hour hand 2 and the minute hand 3 stop at positions where the altitude display process starts, i.e., at positions of 8.5 seconds and 42.5 seconds, respectively.

The CPU 45 then drives the hour hand 2 forward by 189 steps from the position of 8.5 seconds to the position of the number "8" (position of 40 seconds), as shown in FIG. 5B, thus indicating that the altitude is 8,000-meter range (Steps S17 and S18). At this time, the function hand 5 does not move from the position of the mark "m," which indicates that the altitude is not negative (Steps S15 and S16).

The CPU 45 then drives the minute hand 3 forward by 135 steps from the position of 42.5 seconds to the position of the number "1" (position of five seconds), as shown in FIG. 5C, thus indicating that the altitude is 8,100-meter range (Steps S19 and S20). Finally, the CPU 45 drives the second hand 4 forward by 30 steps from the position of zero second to the position of the number "6" (position of 30 seconds), as shown in FIG. 3A, thus indicating that the altitude is 8,160 m (Steps S21 and S22).

The above-mentioned operation procedure and specific example illustrate the operation to display altitude data. The same process is applied to display of barometric pressure data or temperature data.

In the electronic wrist timepiece 1 of the embodiment, a numerical value of three significant digits is represented by the hands 2 to 4 in such a way that each of the hands 2 to 4 directly points to one of the numbers "0" to "9" on the dial plate 11, each of which numbers "0" to "9" corresponds to each digit of the three-digit numerical value. Thus, it is not necessary to read a value between scales in an analog manner. In other words, a value can be displayed in a digital manner as a discrete value, with displayable accuracy.

Even if a value, such as an altitude value, to be displayed is in a range considerably different from time data, it is not necessary to consider roughness or fineness of scales. Thereby, a measured value can be easily and accurately read.

The hour hand 2, the minute hand 3, and the second hand 4 which are rotatable around the same rotation axis are used to indicate respective digits of a numerical value. Thus, a measured value can be easily displayed in a digital manner simply with a total of 10 numbers 0 to 9 on the peripheral portion of the dial plate 11.

In particular, twelve o'clock is associated with the number "0," and one o'clock to nine o'clock are associated with the numbers "1" to "9," respectively. This further makes it easier for a user to read respective digits.

The hour hand 2 represents a high-order digit; the minute hand 3 represents a middle-order digit; the second hand 4 represents a low-order digit. Thus, a measured value can be easily read in the same digit order as in the normal time display.

The hands are driven in the order from the hand representing the highest-order digit to the hand representing the lowest-order digit, after the function hand 5 is driven. This allows a user to easily recognize a measured value.

Since a selected unit is indicated by the function hand 5, a unit used for displaying a value can be switched between meters and feet based on the setting stored in the user setting table 47*a* according to user's preference.

A measured value obtained by the temperature sensor 53 or the pressure sensor 54, or a value calculated based on the measured value can be displayed with accuracy displayable by the hands 2 to 4 and the function hand 5 in a digital manner. This allows a user to know the displayed measured value or calculated value with ease.

Second Embodiment

An electronic wrist timepiece 1 according to a second embodiment will now be described. The configuration of the electronic wrist timepiece 1 according to the second embodiment is the same as that of the electronic wrist timepiece 1 according to the first embodiment, and thus the same reference numerals are assigned without duplicated explanation. The electronic wrist timepiece 1 of the second embodiment is different from the electronic wrist timepiece 1 of the first embodiment only in drive procedures of hands in an altitude display process, a barometric pressure display process, and a temperature display process.

Figure 6:
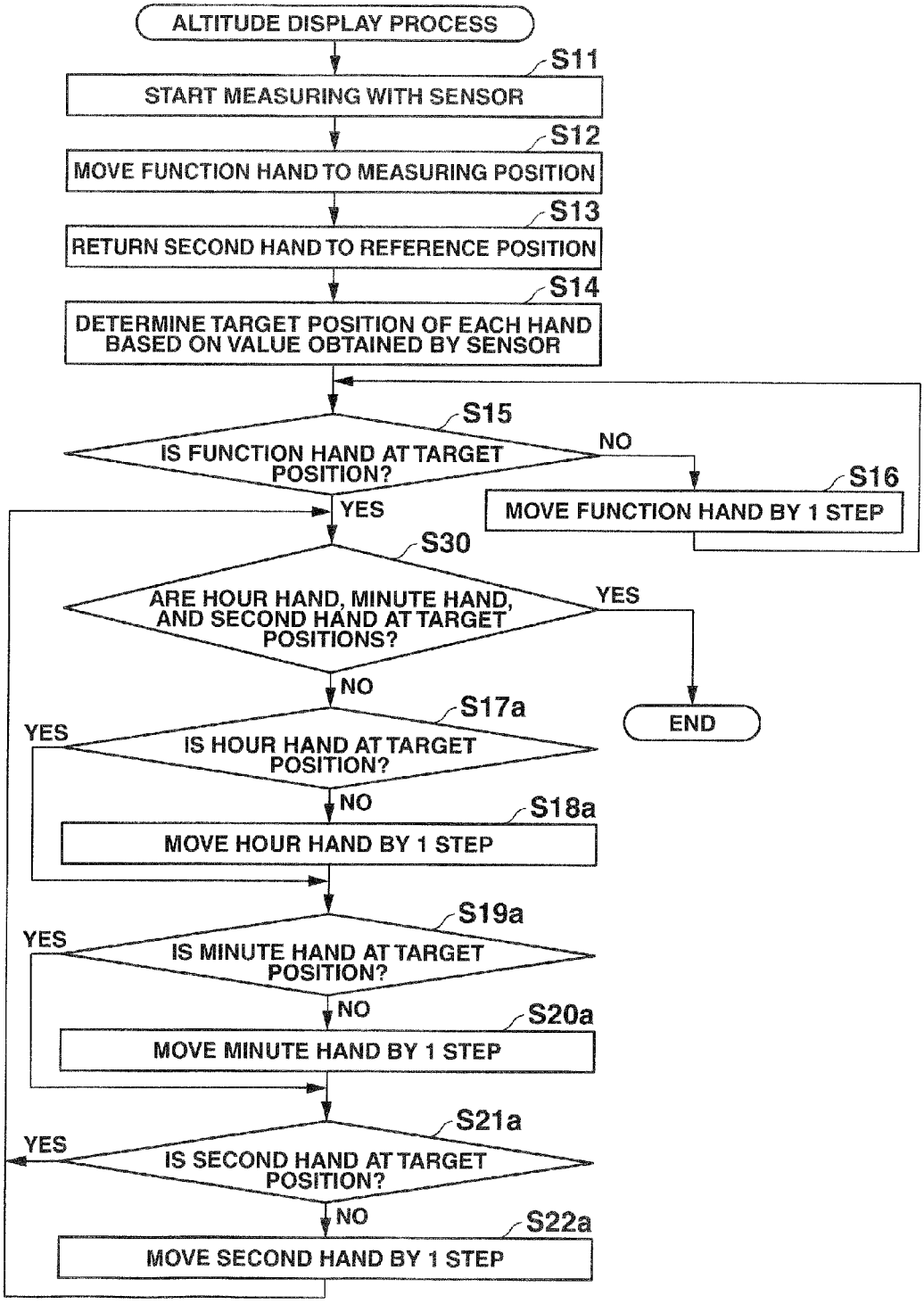
FIG. 6 is a flowchart illustrating a control process for displaying a measured value according to a second embodiment.

FIG. 6 is a flowchart illustrating a control procedure to be performed by the CPU 45 in the altitude display process of the second embodiment.

Steps S11 to S16 in the altitude display process of the second embodiment are the same as those in the altitude display process of the first embodiment. Thus, the same reference numerals are assigned without duplicated explanation.

In Step S15, if the CPU 45 determines that the function hand 5 is located at the set target position, the process of the CPU 45 proceeds to Step S30. The CPU 45 then determines whether all of the hour hand 2, the minute hand 3, and the second hand 4 are located at the set target positions, respectively.

In Step S30, if the CPU 45 determines that at least one of the hour hand 2, the minute hand 3, and the second hand 4 is not located at the set target position, the CPU 45 determines whether the hour hand 2 is located at the set target position (Step S17*a*). If the CPU 45 determines that the hour hand 2 is not located at the set target position, the CPU 45 outputs a drive control signal to the hour hand driver 40 to move the hour hand 2 by one step (Step S18*a*). The process of the CPU 45 then proceeds to Step S19*a*. If the CPU 45 determines that the hour hand 2 is located at the set target position in step S17*a*, the process of the CPU 45 directly proceeds to Step S19*a*.

In Step S19*a*, the CPU 45 determines whether the minute hand 3 is located at the set target position. If the CPU 45 determines that the minute hand 3 is not located at the set target position, the CPU 45 outputs a drive control signal to the minute hand driver 41 to move the minute hand 3 by one step (Step S20*a*). The process of the CPU 45 then proceeds to Step S21*a*. If the CPU 45 determines that the minute hand 3 is located at the set target position, the process of the CPU 45 directly proceeds to Step S21*a*.

In Step S21*a*, the CPU 45 determines whether the second hand 4 is located at the set target position. If the CPU 45 determines that the second hand 4 is not located at the set target position, the CPU 45 outputs a drive control signal to the second hand driver 42 to move the second hand 4 by one step (Step S22*a*). The process of the CPU 45 then returns to Step S30. If the CPU 45 determines that the second hand 4 is located at the set target position, the process of the CPU 45 directly returns to Step S30.

In Step S30, if all of the hour hand 2, the minute hand 3, and the second hand 4 are determined to be located at the set target positions, respectively, the CPU 45 ends the altitude display process.

Thus, the altitude display process of the second embodiment moves the hour hand 2, the minute hand 3, and the second hand 4 in rotation by one step, and ends the hand drive operation in order of arrival at the set target position. Accordingly, even if there is a hand not required to move, a user can clearly recognize that the hand drive operation is completed when the drive ends.

Figure 7A:
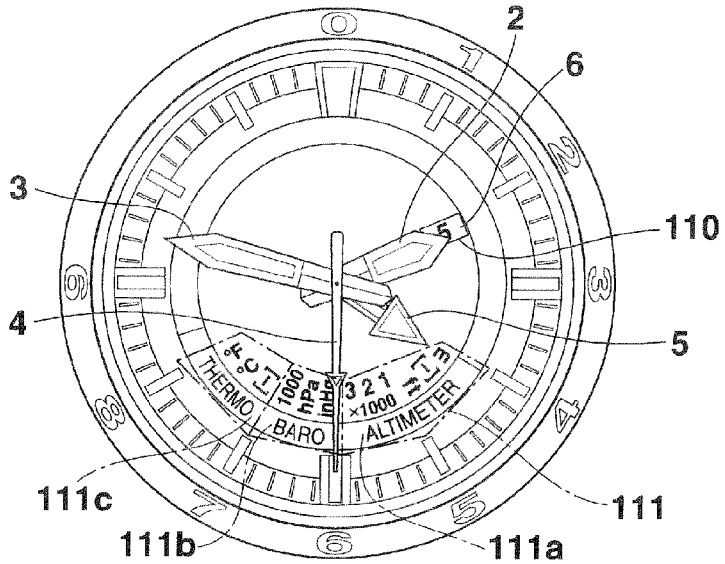
FIGS. 7A and 7B are each a specific example of a procedure for displaying a measured value in an electronic wrist timepiece according to the second embodiment.
Figure 7B:
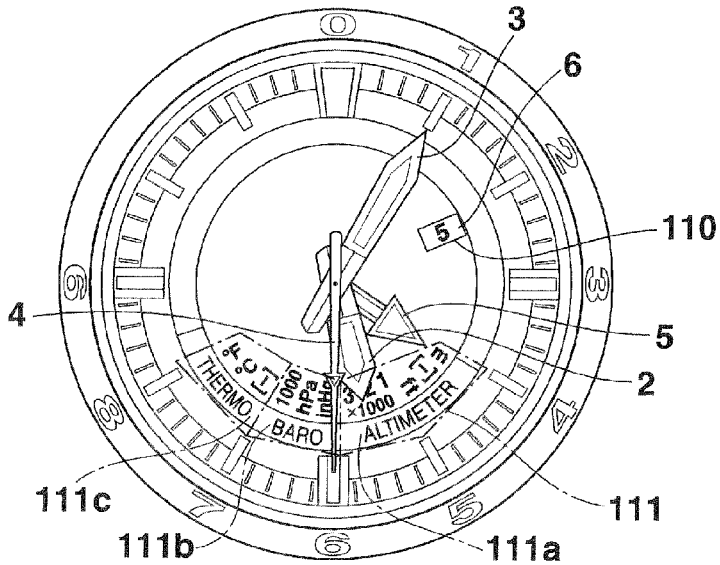

FIGS. 7A and 7B are each a specific example of hand display during the altitude display operation in the electronic wrist timepiece of the second embodiment.

In the case where the altitude display process starts at one o'clock 42 minutes 32 seconds, for instance, the CPU 45 drives the function hand 5 to point to the mark "m" in the altitude display section 111*a* (Step S12) and the second hand 4 to point to the number "0" (Step S13), as shown in FIG. 5A, similar to the altitude display process operation in the first embodiment. Thus, the CPU 45 indicates that the electronic wrist timepiece 1 is in the altitude display mode and that the pressure sensor 54 is measuring the barometric pressure (Step S11). The CPU 45 makes the minute hand 3 and the second hand 2 stop at positions where the altitude display process starts.

The CPU 45 then determines positions to which the hands 2 to 4 and the function hand 5 are to be moved, based on an obtained measured value (Step S14). In the case where the altitude calculated based on a measured value of barometric pressure is 8,160 m, the CPU 45 determines to move the hour hand 2 to the position "8," the minute hand 3 to the position "1," the second hand 4 to the position "6," and the function hand 5 to the position "m."

The CPU 45 then drives the function hand 5. Since the function hand 5 is already located at the position "m" herein, the CPU 45 ends the process without driving the function hand 5 (Steps S15 and S16).

After determining that any of the hour hand 2, the minute hand 3, and the second hand 4 is not located at the target position (Step S30), the CPU 45 drives the hour hand 2, the minute hand 3, and the second hand 4 by one step in rotation (Steps S17*a* to S22*a*). In this display example, all the results of the determination in Steps S17*a*, S19*a*, and S21*a* are "NO" when the hour hand 2, the minute hand 3, and the secondhand 4 are started to be driven. The CPU 45 drives the hour hand 2, the minute hand 3, and the second hand 4 forward in Steps S18*a*, S20*a*, and S22*a*, respectively. When the CPU 45 drives the hands 2 to 4 by 30 steps, the second hand 4 is moved to the position of the number "6," as shown in FIG. 7A, and reaches the target position. The result of the determination in Step S21*a* then changes from "NO" to "YES," and the driving of the second hand 4 in Step S22*a* is not performed.

The CPU 45 then continues to drive the hour hand 2 and the minute hand 3. When the hour hand 2 and the minute hand 3 are driven by 135 steps from the start of the advance drive, the minute hand 3 is moved to the position of the number "1," as shown in FIG. 7B, and reaches the target position. The result of the determination in Step S19*a* then changes from "NO" to "YES," and the driving of the minute hand 3 in Step S20*a* is not performed thereafter.

Finally, the CPU 45 continues to drive only the hour hand 2. When the hour hand 2 is moved to the position of the number "8," as shown in FIG. 3A, the hour hand 2 reaches the target position. The result of the determination in Step S30 then changes from "NO" to "YES," and the CPU 45 ends the altitude display process.

After all the hands have reached the target positions, respectively, the CPU 45 may allow a predetermined hand to perform an operation to indicate that all the hands have been driven. For example, the CPU 45 may transmit a drive control signal to the hour hand driver 40 to reverse the hour hand 2 by a predetermined number of steps (e.g., 30 steps) and then to advance it by the same number of steps. This allows the hour hand 2 to indicate that all the hands have been driven.

According to the electronic wrist timepiece 1 of the second embodiment, the hour hand 2, the minute hand 3, and the secondhand 4 are driven by one step in rotation. Accordingly, the hands 2 to 4 seem to be driven simultaneously, which results in good appearance.

In the case where the CPU 45 performs an operation to indicate that all the hands have been driven, a user can surely recognize that the drive is completed even if there is a hand that is not moved.

Third Embodiment

An electronic wrist timepiece 1 according to a third embodiment will now be described. The configuration of the electronic wrist timepiece 1 according to the third embodiment is the same as that of the electronic wrist timepiece 1 according to the first embodiment and the second embodiment, and thus the same reference numerals are assigned without duplicated explanation. The electronic wrist timepiece 1 of the third embodiment is different from the electronic wrist timepiece 1 of the first embodiment and the second embodiment only in drive procedures of hands in an altitude display process, a barometric pressure display process, and a temperature display process.

Figure 8:
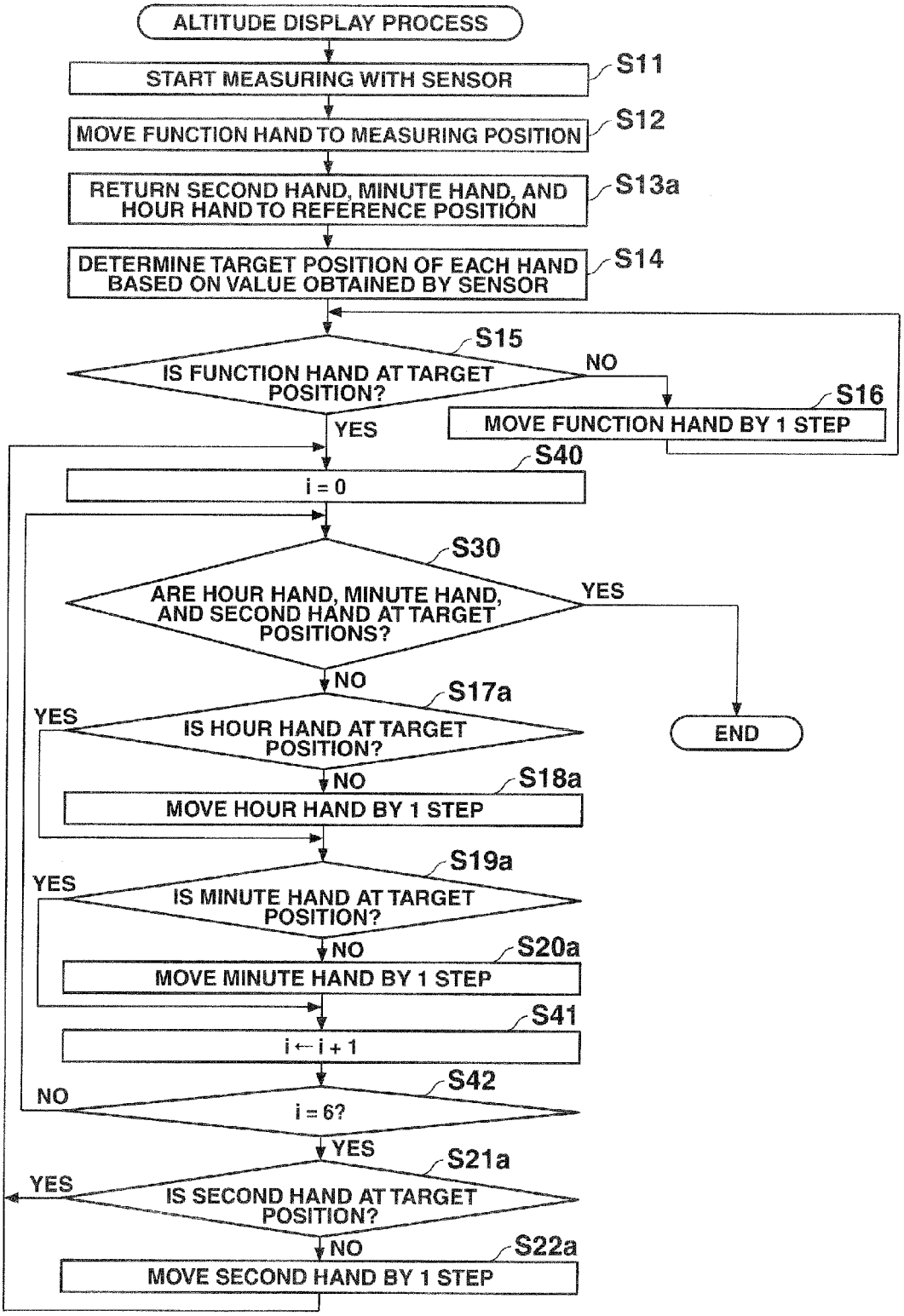
FIG. 8 is a flowchart illustrating a control process for displaying a measured value according to a third embodiment.

FIG. 8 is a flowchart illustrating a control procedure to be performed by a CPU in the altitude display process in the third embodiment.

Steps S11, S12, S14 to S16, S17*a* to S22*a*, and S30 in the altitude display process of the third embodiment are the same as those in the altitude display process of the second embodiment. Thus, the same reference numerals are assigned without duplicated explanation.

In the altitude display process of the third embodiment, the CPU 45 returns the minute hand 3 and the hour hand 2 to the reference position together with the secondhand 4 in Step S13*a*.

If the CPU 45 determines "YES" in Step S15, the CPU 45 sets a variable i to zero (Step S40) and then performs the determination process in Step S30.

If the CPU 45 determines "YES" in Step S19*a* and after Step S20*a* ends, the CPU 45 adds one to the variable i (Step S41). The CPU 45 then determines whether the variable i is six (Step S42). If the CPU 45 determines that the variable i is not six, the CPU 45 returns to Step S30. If the variable i is determined to be six, the process of the CPU 45 goes on to Step S21*a*.

If CPU 45 determines "YES" in Step S21*a* and after Step S22*a* ends, the process of the CPU 45 returns to Step S40.

Thus, in the electronic wrist timepiece 1 of the third embodiment, all of the hour hand 2, the minute hand 3, and the second hand 4 are returned to the reference position at the beginning of measurement. Then, the hands 2 to 4 are driven by predetermined numbers of steps, respectively, in rotation. At this time, the hour hand 2 and the minute hand 3 each have 360 steps per circle, while the second hand 4 has 60 steps per circle. Accordingly, the second hand 4 is driven by one step every time the hour hand 2 and the minute hand 3 are driven by six steps. In this way, the hands can be driven at the same average speed (½ in reverse) from the direction of zero o'clock.

Figure 9A:
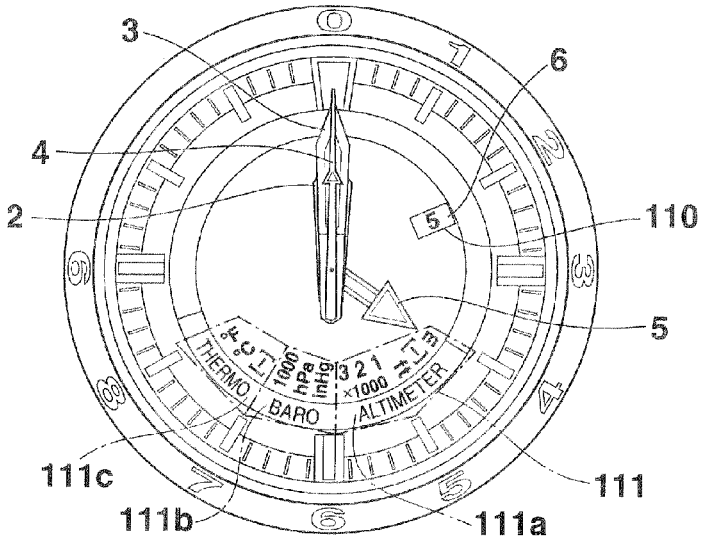
FIGS. 9A to 9C are each a specific example of a procedure for displaying a measured value in an electronic wrist timepiece according to the third embodiment.
Figure 9B:
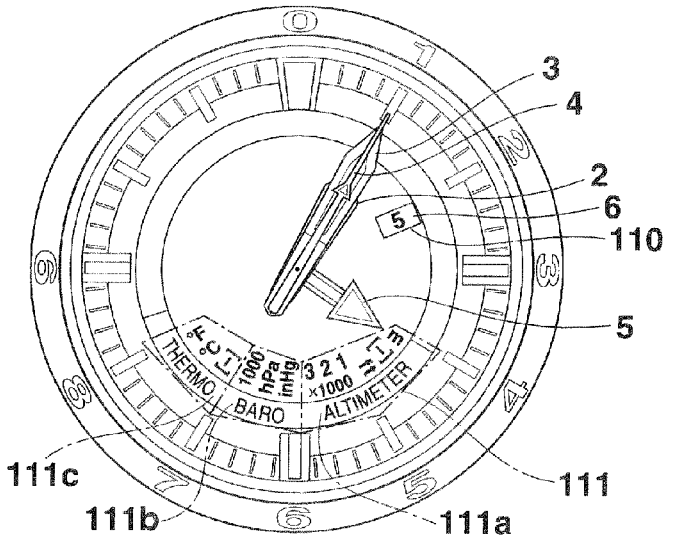
Figure 9C:
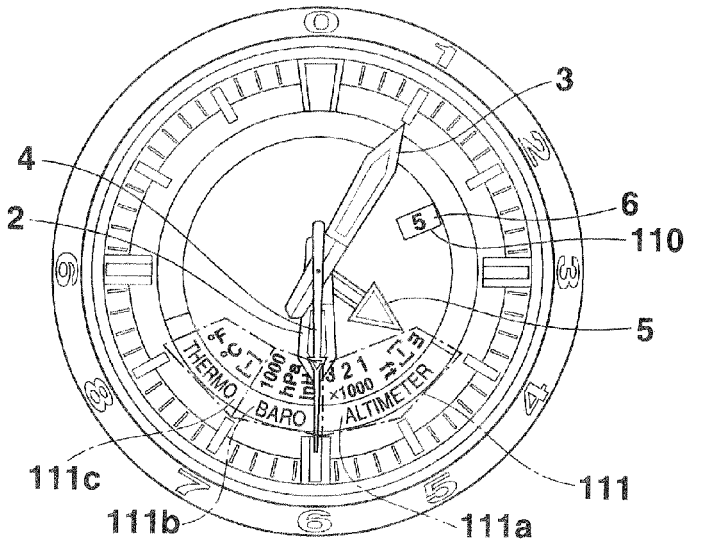

FIGS. 9A to 9C are each a specific example of hand display during the altitude display operation in the electronic wrist timepiece of the third embodiment.

When the altitude display process starts at one o'clock 42 minutes 32 seconds, for instance, the CPU 45 drives the function hand 5 to point to the mark "m" in the altitude display section 111*a* (Step S12) and all the second hand 4, the minute hand 3, and the hour hand 2 to point to the number "0" (Step S13*a*), as shown in FIG. 9A. If the pressure sensor 54 has not finished barometric pressure measurement during this process, the barometric pressure measurement is performed in parallel in the electronic wrist timepiece 1 (Step S11).

The CPU 45 then determines positions to which the hands 2 to 4 and the function hand 5 are to be moved, based on a measured value (Step S14). In the case where the altitude is 8,160 m, the CPU 45 determines to move the hour hand 2 to the position "8," the minute hand 3 to the position "1," the second hand 4 to the position "6," and the function hand 5 to the position "m."

The CPU 45 then drives the function hand 5. Since the function hand 5 is already located at the position "m" herein, the CPU 45 ends the process without driving the function hand 5 (Steps S15 and S16).

After determining that any of the hour hand 2, the minute hand 3, and the second hand 4 is not located at the target position (Step S30), the CPU 45 drives the hour hand 2 and the minute hand 3 by one step alternately, up to six steps (Steps S17*a* to S20*a*). After the hour hand 2 and the minute hand 3 are each driven by six steps (Steps S40, S41, and S42), the CPU 45 sequentially drives the second hand 4 by one step (Steps S21*a* and S22*a*). In this display example, the results of the determinations in both Steps S17*a* and S19*a* are "NO" when the hour hand 2, the minute hand 3, and the secondhand 4 are started to be driven. The CPU 45 drives the hour hand 2 and the minute hand 3 forward in Steps S18*a* and S20*a*, respectively. Furthermore, the result of the determination in Step S21*a* is also "NO." The CPU 45 drives the second hand 4 forward in Step S22*a*. When the CPU 45 drives each of the hands 2 and 3 by 30 steps and drives the second hand 4 by five steps, the hands 2 to 4 are moved to the number "1," as shown in FIG. 9B; hence, the minute hand 3 reaches the target position. The result of the determination in Step S19*a* then changes from "NO" to "YES," and the driving of the minute hand 3 in Step S20*a* is not performed.

The CPU 45 then continues to drive the hour hand 2 and the second hand 4. When the CPU 45 drives the hour hand 2 by 180 steps and drives the secondhand 4 by 30 steps from the start of forward driving, the hour hand 2 and the second hand 4 are moved to the number "6," as shown in FIG. 9C; hence, the second hand 4 reaches the target position. The result of the determination in Step S21*a* then changes from "NO" to "YES," and the driving of the second hand 4 in Step S22*a* is not performed thereafter.

Finally, the CPU 45 continues to drive only the hour hand 2. When the hour hand 2 is driven by 240 steps from the start of forward driving, the hour hand 2 is moved to the position of the number "8," as shown in FIG. 3A, and reaches the target position. The result of the determination in Step S30 then changes from "NO" to "YES," and the CPU 45 ends the altitude display process.

According to the electronic wrist timepiece 1 of the third embodiment, the CPU 45 drives the hands 2 to 4 to display a measured value in such a way that the hour hand 2 and the minute hand 3, whose number of steps is different from that of the second hand 4, move at the same pace as the second hand 4. This improves the appearance of the hands 2 to 4 during driving and makes it easier to move the hands 2 to 4 to the target positions at an appropriate timing.

The present invention is not limited to the embodiments above and may be modified in a variety of ways.

For example, in the embodiments above, measured values of temperature, barometric pressure, and altitude are displayed using the temperature sensor 53 and the pressure sensor 54. However, a physical quantity to be measured is not limited thereto. For instance, hydraulic pressure, humidity, acceleration, or the like may also be measured and displayed.

In addition to a measured value, a value calculated based on a measured value may also be displayed, such as a discomfort index calculated from temperature and humidity. Furthermore, a displayed value is not limited to a value based on a measured value, but may also be a lunar age calculated from time data stored in the timing circuit 50 or any numerical value within a displayable range of the electronic wrist timepiece 1 set by a user's operation.

In the embodiments above, twelve o'clock and one o'clock to nine o'clock are associated with numbers 0 and 1 to 9, but the association is not limited to such a correspondence. For example, the position often o'clock may be associated with the number 0. Alternatively, a completely different placement may be employed. Furthermore, the positions associated with the numbers 0 to 9 may be set within the range of one o'clock to six o'clock, without associating each number with each hour. This improves readability of an expressed numerical value because the numbers can be read from left to right.

In the embodiments above, a numerical value of three significant digits is represented by the hands 2 to 4 and the function mode is represented by the function hand 5. Alternatively, a numerical value of two significant digits may be represented by any two of the hands 2 to 4 and the function mode may be represented by the remaining hand. Alternatively, some of a plurality of function hands may be used to express a numerical value of four digits or more. Furthermore, the rotation axis of the function hand 5 may be provided at a different position from that of the hands 2 to 4, for example, at a separate position in a small window.

In the embodiments above, the hour hand 2 represents a high-order digit and the second hand 4 represents a low-order digit, but representation is not limited to such a combination. For example, the second hand 4 may be longer than the minute hand 3, and the relationship between a hand and a digit order may be determined such that a longer hand represents a higher-order digit. With such a configuration, in the case where the positions associated with the numbers 0 to 9 are set within the range of six o'clock to twelve o'clock, readability of an expressed numerical value is improved because the numbers can be read from left to right.

In the third embodiment above, the hour hand 2 and the minute hand 3 are driven by one step, but the number of steps to be driven at one time is not limited to one step. For example, the hands may be moved by two steps at one time.

In the embodiments above, the numbers "0" to "9" that indicate respective digits of a measured value are provided in the peripheral portion of the dial plate 11, but may be provided in the bezel 13, for instance. Alternatively, the numbers "0" to "9" may be omitted since positions associated with the respective digits are positions of respective hours on the dial plate 11, and thus the respective digits are equal to the hours.

In the embodiments above, the electronic timepiece having only analog display with hands is described. Instead, the electronic timepiece may also have a digital display, such as a liquid crystal display.

In the embodiments above, a wrist timepiece is described as an example. The present invention may also be applied to a table timepiece, a wall timepiece, and a pocket table timepiece.

In addition, the specific structures, placements, and control sequences described in the embodiments above may be modified appropriately without deviating from the concept of the present invention.

The entire disclosure of Japanese Patent Application No. 2011-167946 filed on Aug. 1, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An analog electronic timepiece comprising:

a plurality of hands;

a dial plate having scales for time display;

a driving unit that drives the hands in such a way that the hands are driven independently of each other; and a control unit that transmits a drive signal to the driving unit and moves the hands to allow the hands to point to positions set for the respective hands, wherein the control unit (i) allows each of the hands to point to one of positions of one o'clock to nine o'clock and twelve o'clock among the scales for time display to indicate that a digit in a predetermined place represented by each of the hands is one of "1" to "9" and "0"; and (ii) expresses a numerical value by a combination of digits corresponding to the respective positions pointed by the respective hands.

2. The analog electronic timepiece according to claim 1, wherein the hands are a second hand, a minute hand, and an hour hand; and a highest-order digit of the expressed numerical value is represented by the hour hand and a lowest-order digit of the expressed numerical value is represented by the second hand.

3. The analog electronic timepiece according to claim 2, further comprising:

at least one function hand, wherein the dial plate has function scales indicating a type of a numerical value expressible by the hands and/or information supplementary to the expressible numerical value; and the control unit allows the driving unit to drive the function hand independently of the hands to move the function hand to a set position among the function scales.

4. The analog electronic timepiece according to claim 3, wherein the hands and the function hand rotate around an identical rotation axis.

5. The analog electronic timepiece according to claim 2, wherein the control unit moves the hands one by one to the respective set positions in sequence.

6. The analog electronic timepiece according to claim 2, wherein the control unit drives the hands in rotation, each of the hands being driven by a predetermined number of steps at one time.

7. The analog electronic timepiece according to claim 2, further comprising:

a measuring unit that measures a predetermined physical quantity, wherein the control unit expresses, by using the hands, a numerical value based on a measured value obtained by the measuring unit.

8. The analog electronic timepiece according to claim 1, wherein the hands are a second hand, a minute hand, and an hour hand;

the second hand is longer than the minute hand, and the hour hand is the shortest; and a lowest-order digit of the expressed numerical value is represented by the hour hand and a highest-order digit of the expressed numerical value is represented by the second hand.

9. The analog electronic timepiece according to claim 8, further comprising:

at least one function hand, wherein the dial plate has function scales indicating a type of a numerical value expressible by the hands and/or information supplementary to the expressible numerical value; and the control unit allows the driving unit to drive the function hand independently of the hands to move the function hand to a set position among the function scales.

10. The analog electronic timepiece according to claim 9, wherein the hands and the function hand rotate around an identical rotation axis.

11. The analog electronic timepiece according to claim 8, wherein the control unit moves the hands one by one to the respective set positions in sequence.

12. The analog electronic timepiece according to claim 8, wherein the control unit drives the hands in rotation, each of the hands being driven by a predetermined number of steps at one time.

13. The analog electronic timepiece according to claim 8, further comprising:

a measuring unit that measures a predetermined physical quantity, wherein the control unit expresses, by using the hands, a numerical value based on a measured value obtained by the measuring unit.

14. The analog electronic timepiece according to claim 1, further comprising:

at least one function hand, wherein the dial plate has function scales indicating a type of a numerical value expressible by the hands and/or information supplementary to the expressible numerical value; and the control unit allows the driving unit to drive the function hand independently of the hands to move the function hand to a set position among the function scales.

15. The analog electronic timepiece according to claim 14, wherein the hands and the function hand rotate around an identical rotation axis.

16. The analog electronic timepiece according to claim 14, wherein the control unit moves the hands one by one to the respective set positions in sequence.

17. The analog electronic timepiece according to claim 14, wherein the control unit drives the hands in rotation, each of the hands being driven by a predetermined number of steps at one time.

18. The analog electronic timepiece according to claim 1, wherein the control unit moves the hands one by one to the respective set positions in sequence.

19. The analog electronic timepiece according to claim 1, wherein the control unit drives the hands in rotation, each of the hands being driven by a predetermined number of steps at one time.

20. The analog electronic timepiece according to claim 1, further comprising:

a measuring unit that measures a predetermined physical quantity, wherein the control unit expresses, by using the hands, a numerical value based on a measured value obtained by the measuring unit.

* * * * *